US006883791B1

(12) United States Patent
Liang et al.

(10) Patent No.: US 6,883,791 B1
(45) Date of Patent: Apr. 26, 2005

(54) SUCTION DEVICE

(75) Inventors: Chi-Wang Liang, No. 111, Minsiang St., Jhonghe City, Taipei County 235 (TW); Chung-Heng Yang, Taiping (TW)

(73) Assignee: Chi-Wang Liang, Taipei (TW)

( * ) Notice: Subject to any disclaimer, the term of this patent is extended or adjusted under 35 U.S.C. 154(b) by 3 days.

(21) Appl. No.: 10/796,007

(22) Filed: Mar. 10, 2004

(51) Int. Cl.[7] ..... B25B 11/00
(52) U.S. Cl. ..... 269/21; 269/289 R
(58) Field of Search ..... 269/21, 20, 289 R; 451/388; 279/3; 294/64.1

(56) References Cited

U.S. PATENT DOCUMENTS 5,562,276 A * 10/1996 Blick ..... 269/20
5,853,169 A * 12/1998 Hern et al. ..... 269/21
6,286,822 B1 * 9/2001 Blick ..... 269/21
6,439,559 B1 * 8/2002 Kinnard et al. ..... 269/21

* cited by examiner

*Primary Examiner*—Lee D Wilson
(74) *Attorney, Agent, or Firm*—Browdy and Neimark, P.L.L.C.

(57) ABSTRACT

A suction device includes a substrate having a plurality of aperture, in each of which an inner ring, a plug and an outer ring are mounted. The plug is moved between the inner ring and the outer ring. The inner ring and the plug are made of a magnet and a magnetic material to attach the plug on the inner ring to seal an axial hole of the inner ring. The plug will move to the outer ring by an external force, such as airflow, to seal an axial hole of the outer ring. An air guide plate is attached on the substrate and has a plurality of channels to be communicated to the axial holes of the outer rings respectively and to extract air therefrom.

9 Claims, 4 Drawing Sheets

SUCTION DEVICE

BACKGROUND OF THE INVENTION

1. Field of the Invention

The present invention relates generally to an automatic machine, and more particularly to a suction device, which sucks various sizes of objects and has a function of preventing air leakage to increase the efficiency of suction.

2. Description of the Related Art

A conventional suction device has a substrate having a plurality of apertures. Objects for work are put on the substrate and the air below the substrate is extracted to provide a condition of the atmospheric pressure above the substrate much greater than the atmospheric pressure below the substrate. Therefore, the objects are sucked on the substrate firmly for work.

The conventional suction device must arrange the apertures just meeting the sizes and the sharps of the objects to make the objects sealing all the apertures, such that the suction device has a well efficiency of suction. If there is one ore more apertures not sealed, the air above the substrate flows through the substrate via the unsealed aperture and we call that "air leakage". If there is air leakage occurred, the suction device has a poor capacity of suction to hold the objects on the substrate.

SUMMARY OF THE INVENTION

The primary objective of the present invention is to provide a suction device, which firmly holds objects with various sizes.

The secondary objective of the present invention is to provide a suction device, which has no problem of air leakage and has a high efficiency of suction.

According to the objectives of the present invention, a suction device comprises a substrate having an aperture, which has a small diameter portion, a large diameter portion and a shoulder portion between the small diameter portion and the large diameter portion. An inner ring is received in the large diameter portion of the aperture of the substrate and attached on the shoulder portion, wherein the inner ring has an axial hole communicated with the small diameter portion of the aperture. An outer ring is received in the large diameter portion of the aperture of the substrate and has an axial hole. A plug is received in the large diameter portion of the aperture of the substrate for movement between the inner ring and the outer ring. The plug is attached on the inner ring at initial to be moved to the outer ring and attached thereon by an external force.

DETAILED DESCRIPTION OF THE INVENTION

Figure 1:
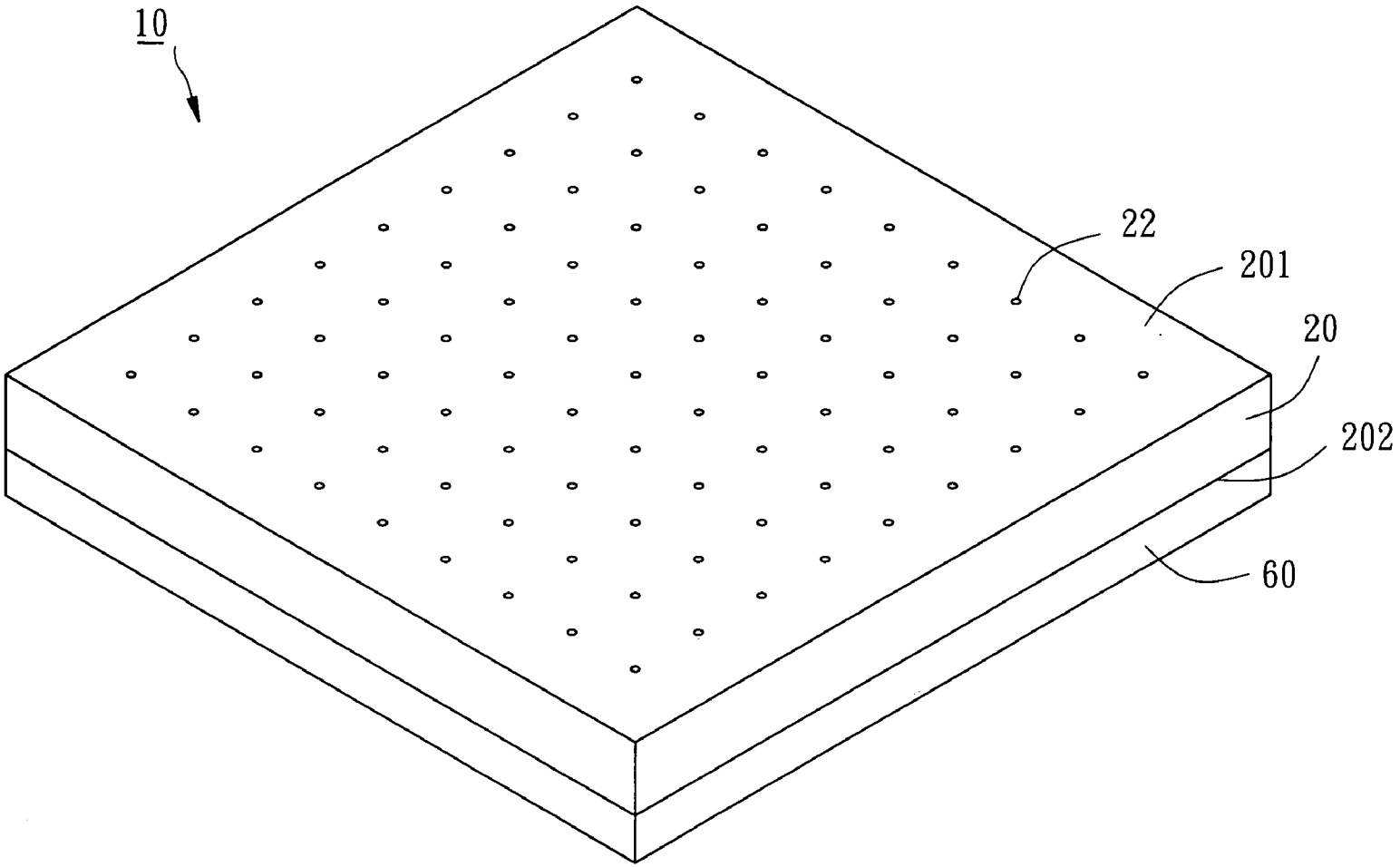
FIG. 1 is a perspective view of a first preferred embodiment of the present invention.
Figure 2:
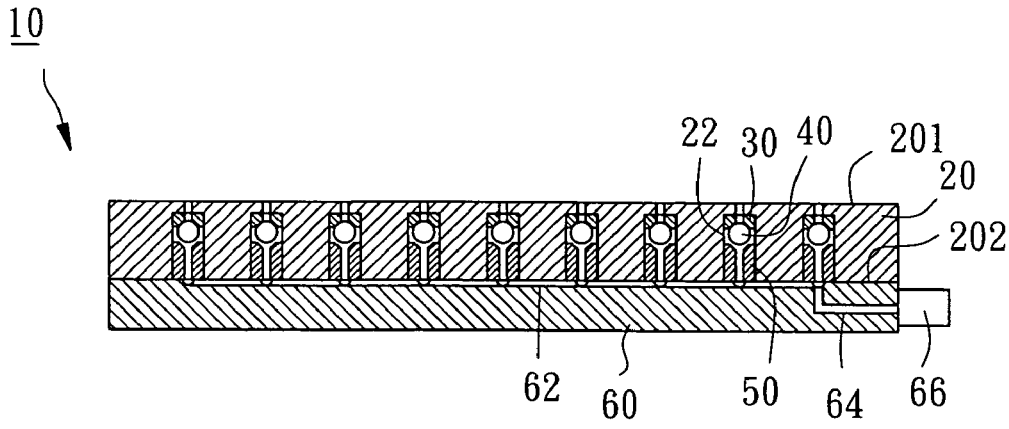
FIG. 2 is a sectional view of the first preferred embodiment of the present invention.
Figure 3:
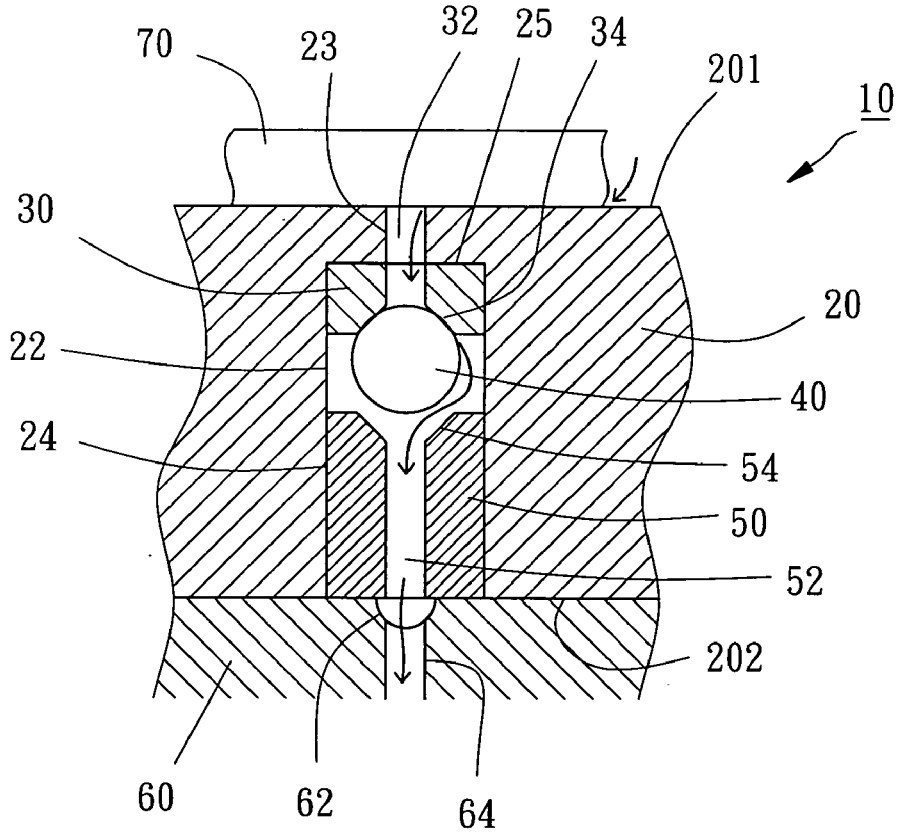
FIG. 3 is a sectional view in part of the first preferred embodiment of the present invention.

As shown in FIGS. from FIG. 1 to FIG. 3, a suction device 10 of the first preferred embodiment of the present invention comprises a substrate 20, inner rings 30, plugs 40, outer rings 50 and an air guide plate 60.

The substrate 20 has a top side 201, a bottom side 202 and a plurality of apertures 22 through the substrate 20 from the top side 201 to the bottom side 202. The apertures 22 each have a small diameter portion 23, a large diameter portion 24 and a shoulder portion 25 therebetween. The substrate 20 is made of a nonmagnetic material, such as aluminum.

The inner rings 30 are received in proximal ends of the large diameter portions 24 of the apertures 22 of the substrate 20 and attached on the shoulder portion 25 respectively. Each inner ring 30 has an axial hole 32 connected to the small diameter portion 23 and an annular side attached on a sidewall of the large diameter portions 24 tightly. The inner ring 30 further has a cone portion 34 at a bottom end of a sidewall of the axial hole 32. In the present preferred embodiment, the inner ring 30 is made of a magnetic material, such as a magnet.

The plugs 40 are received in the large diameter portions 24 of the apertures 22 of the substrate 20 respectively. Each plug 40 is a ball in the present preferred embodiment and is made of a magnetic material, such as iron. The plug 40 is attracted by the inner ring 30 to be received in the cone portion 34 of the inner ring 30 and to seal the axial hole 32.

The outer rings 50 are received in distal ends of the large diameter portions 24 of the apertures 22 of the substrate 20 respectively. The outer ring 50 has an axial hole 52 and an annular side attached on a sidewall of the large diameter portions 24 tightly. The outer ring 50 further has a cone portion 54 at an inner end thereof aligning the plug 40. The outer ring 50 is made of a nonmagnetic material, such as aluminum.

Figure 4:
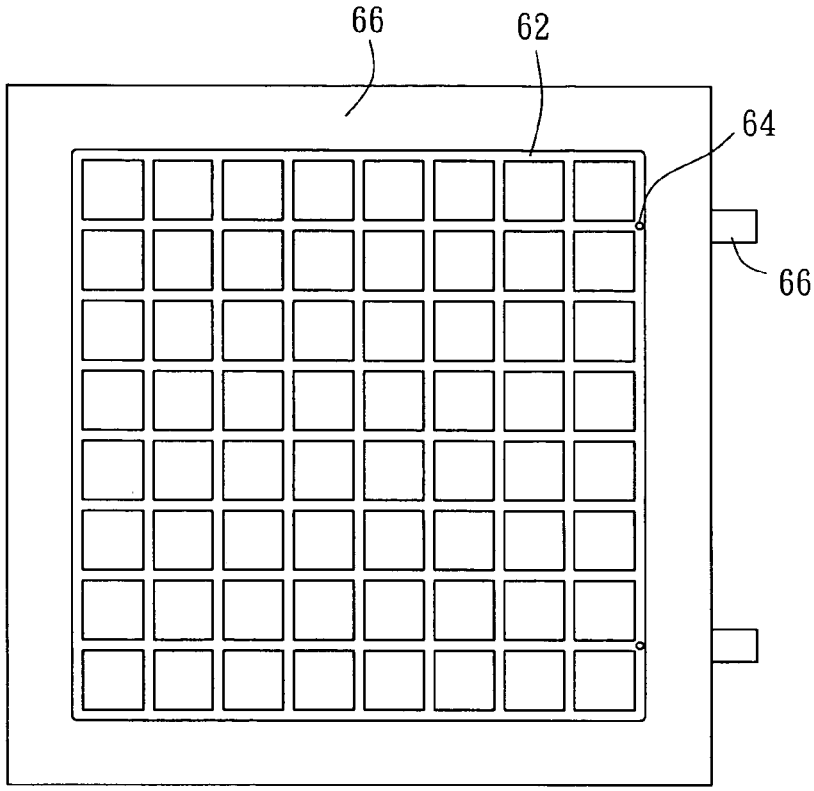
FIG. 4 is a top view of the air guide plate of the first preferred embodiment of the present invention.

The air guide plate 60 is attached on the bottom side 202 of the substrate 20, as shown in FIG. 2, FIG. 3 and FIG. 4. The air guide plate 60 has a plurality of cross channels 62 on the side attached to the substrate 20 to be communicated with the axial holes 52 of the outer rings 50 respectively. The air guide plate 60 further has a airway 64 therein having an end thereof connected to the channels 62 respectively and the other end thereof coupled with a connector 66 to be connected to an air extractor (not shown).

While objects 70 are put on the top side 201 of the substrate 20, some of the apertures 22 are covered by the objects 70 and some of them are not. As shown in FIG. 3, for an aperture 22 covered by the object 70, the plug 40 is attracted by the inner ring 30 and the air is extracted to the air extractor from the space between the object 70 and the substrate 20, via the small diameter portion 23, the axial hole 32 of the inner ring 30, the gap between the inner ring 30 and the plug 40, the axial hole 52 of the outer ring 50, the channel 62 and the airway 64 of the air guide plate 60, shown as the arrows in FIG. 3. The pressure (an atmospheric pressure) above the object 70 is much greater than the pressure under the object 70 and that makes the object 70 being held on the substrate 20 firmly. It has to be mentioned that the attraction force between the inner ring 30 and the plug 40 is smaller than the power of the pressure difference so that there is the gap between the inner ring 30 and the plug 40.

Figure 5:
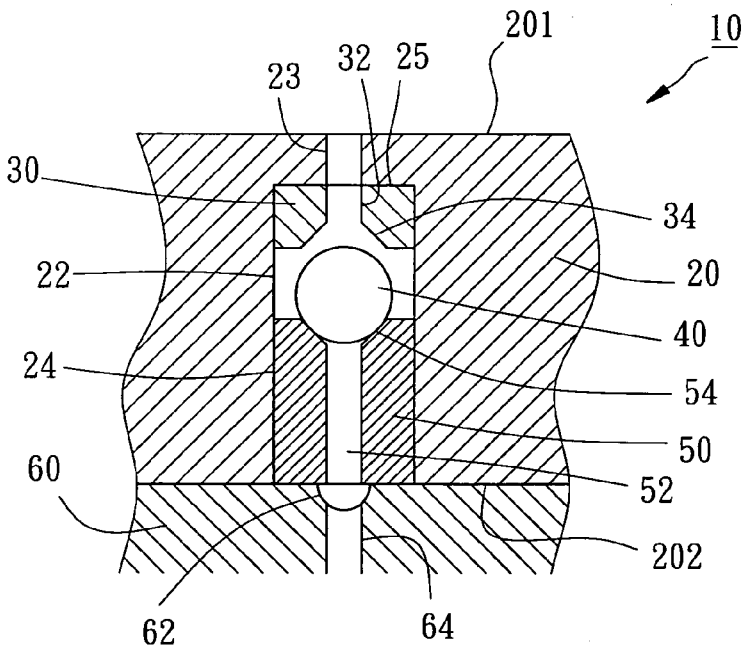
FIG. 5 is a sectional view in part of the first preferred embodiment of the present invention, showing how the device works.

For an aperture 22 not covered by the object 70, as shown in FIG. 5, a large amount of air flows into the aperture 22. The power of the airflow is greater than the attraction of the inner ring 30 and the plug 40 such that the airflow pushes plug 40 downwards and forces it attached to the cone portion 54 of the outer ring 50 tightly. Such that the axial hole 52 of the outer ring 50 is sealed and no air will flows through the aperture 22.

In other words, the apertures 22, which are cover by the objects 70, have a power of suction to hold the objects 70 firmly and the rest apertures 22, which are not cover by the object 70 or there is a larger gap between the aperture 22 and the object 70, are sealed by the plugs 40 plugging the axial holes 52 of the outer rings 50 respectively. Although there is a large amount of air leakage occurred after the air extractor working, these apertures 22 would be sealed in a short period. That makes the suction device 10 of the present invention has barely air leakage, no matter the sizes and the sharps of the objects 70 put on the substrate 20, and the suction device 10 of the present invention provides a high vacuum under the substrate 20 that increases the efficiency of the present invention and fixes the problem of the conventional device.

According to the present invention, the plug 40 has to be attached on the inner ring 30 at initial and the first preferred embodiment provides the inner ring 40 to be a magnet and the plug 40 to be attracted by the inner ring 30. It also can provide the inner ring 30 and plug 40 both are magnets or the plug 40 is a magnet and the inner ring is attracted by the magnet.

Figure 6:
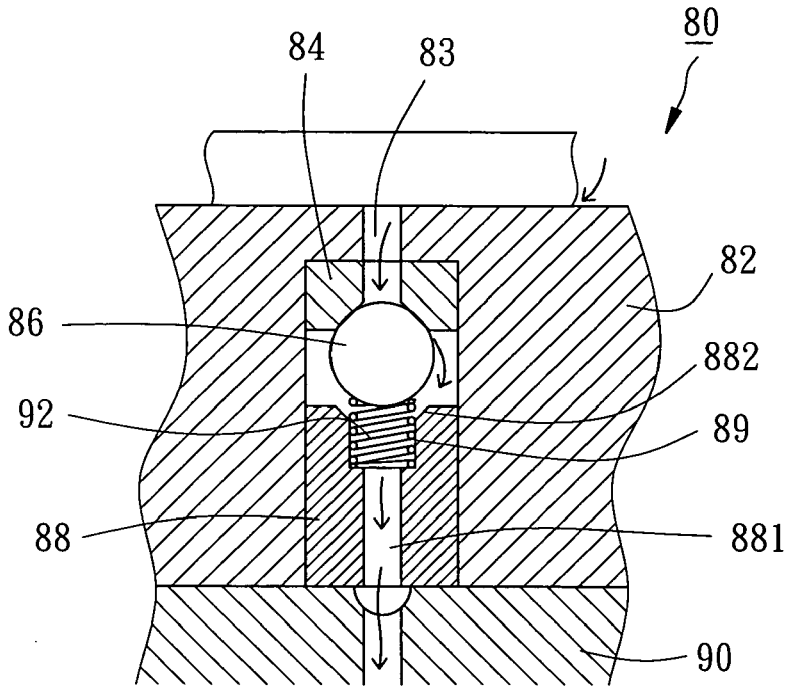
FIG. 6 is a sectional view of a second preferred embodiment of the present invention.
Figure 7:
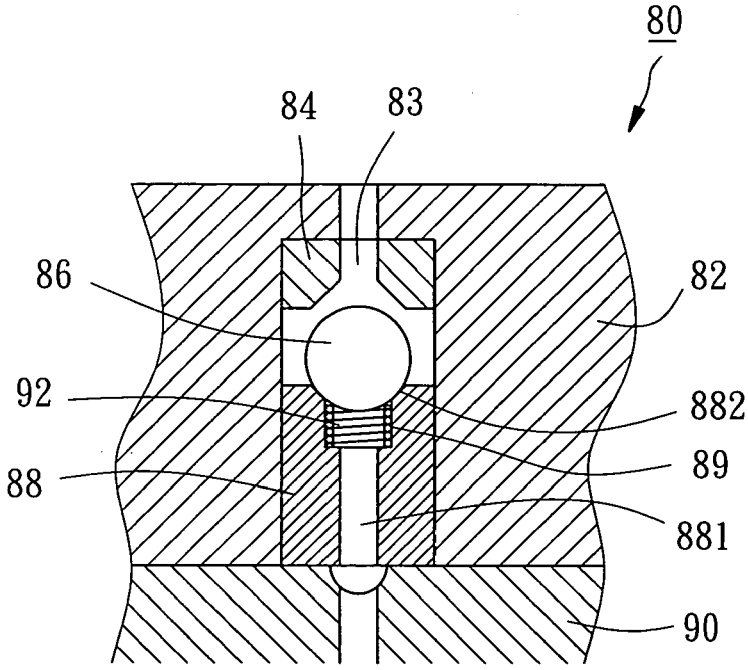
FIG. 7 is a sectional view in part of the second preferred embodiment of the present invention, showing how the device works.

FIG. 6 and FIG. 7 show a suction device 80 of the second preferred embodiment of the present invention, which is similar to the suction device 10 of the first preferred embodiment, having a substrate 82 and an air guide plate 90. The substrate 82 has a plurality of apertures 83, in each of which an inner ring 84, a plug 86, an outer ring 88 and an elastic member 92 are mounted. The outer ring 88 has a mount portion 89 at an end of an axial hole 881 thereof to be engaged with the elastic member 92. The other end of the elastic member 92 is against the plug 86 to force the plug 86 attached on the inner ring 84 at initial.

For the aperture 83 of the substrate 82 covered by an object 94, air is extracted via the arrows-shown in FIG. 6, and for a aperture 83 of the substrate 82 not covered by an object 94, a large amount of air flows into the aperture 83 and the airflow pushes the plug 86 downward to be attached on a cone portion 882 of the outer ring 88 to prevent air leakage.

What is claimed is:

1. A suction device, comprising:

a substrate having an aperture, which has a small diameter portion, a large diameter portion and a shoulder portion between the small diameter portion and the large diameter portion;

an inner ring received in the large diameter portion of the aperture of the substrate and attached on the shoulder portion, wherein the inner ring has an axial hole communicated with the small diameter portion of the aperture;

an outer ring received in the large diameter portion of the aperture of the substrate having an axial hole;

a plug attached on the inner ring and moveable between the inner ring and the outer ring.

2. The suction device as defined in claim 1, wherein the inner ring has a cone portion at an end of the axial hole.

3. The suction device as defined in claim 1, wherein the outer ring has a cone portion at an end of the axial hole.

4. The suction device as defined in claim 1, wherein the plug is a ball.

5. The suction device as defined in claim 1, wherein the inner ring is made of a magnet and the plug is made of a magnetic material to be attracted by the inner ring.

6. The suction device as defined in claim 1, wherein the plug is made of a magnet and the inner ring is made of a magnetic material to be attracted by the plug.

7. The suction device as defined in claim 1, further comprising an air guide plate attached on the substrate, wherein the air guide plate has a channel communicated with the axial hole of the outer ring and an air way communicated with the channel and outside.

8. The suction device as defined in claim 1, comprising an elastic member received in the large diameter portion of the aperture of the substrate to be against the outer ring and the plug respectively.

9. The suction device as defined in claim 8, wherein the outer ring is provided with a mount portion to be engaged with an end of the elastic member.

* * * * *